United States Patent [19]

Aoi et al.

[11] Patent Number: 4,764,745

[45] Date of Patent: Aug. 16, 1988

[54] SLIDE SWITCH WITH EXTERNALLY MOUNTED PROTECTIVE CIRCUIT BREAKER

[75] Inventors: Tatsuo Aoi, Ibaragi; Yasuhrio Kiyono, Nagaokakyo; Sueaki Honda, Kurayoshi; Hauro Atsumi, Shizuoka, all of Japan

[73] Assignee: Omron Tateisi Electronics Co., Kyoto, Japan

[21] Appl. No.: 936,081

[22] Filed: Nov. 28, 1986

[51] Int. Cl.[4] ..... H01H 15/00; H01H 37/00

[52] U.S. Cl. ..... 337/2; 200/16 C; 200/16 D

[58] Field of Search ..... 200/16 R, 16 C, 16 D, 200/11 G, 11 J, 11 K; 337/2

[56] References Cited

U.S. PATENT DOCUMENTS

| | | | |
|---|---|---|---|
| 2,977,435 | 3/1961 | Spicer, Jr. | 200/16 C X |
| 3,150,240 | 9/1964 | Voss | 200/16 C X |
| 3,270,149 | 8/1966 | O'Shea et al. | 200/16 C |
| 3,461,252 | 8/1969 | Vananzi | 200/16 C |
| 3,846,596 | 11/1974 | Wolf | 200/16 D |
| 3,858,012 | 12/1974 | Lockard | 200/16 D |
| 4,475,015 | 10/1984 | Kobayashi et al. | 200/16 C X |

FOREIGN PATENT DOCUMENTS

| | | | |
|---|---|---|---|
| 1408062 | 12/1965 | France | 200/16 D |

*Primary Examiner*—J. R. Scott

*Attorney, Agent, or Firm*—Wegner & Bretschneider

[57] ABSTRACT

In this construction there are provided: a case; several contact members exposed within the case; several lead terminals electrically connected to some of the contact members, and a support member, all insert molded in the case and protruding outwards; and a circuit breaker provided outside the case, one of its ends supported by a lead terminal and its other end supported by the support member. Thereby compact and efficient unitary construction are attained, and space within a device to which this construction is to be fitted, can be economized. The contact members may be five in number, and may be arranged within the case for contact in a linear relationship, alternatingly serving as input side and output side contact members, with the end ones and the middle one serving for being switched between while the other two serve as common contact members. In this case, the two end contact members should be electrically connecetd together, and the construction may further include a pair of contact members which slidingly move, in synchronization, over the common contact members and their neighboring contacts. Alternatively, the construction may further include a movable contact member mounted slidably over the contact members with one of its surfaces confronting a surface of a slidable impeller member, one of these surfaces being formed with a hemispherical protuberance and the other being formed with a hemispherical depression cooperating therewith, thus coupling together these members.

3 Claims, 5 Drawing Sheets

SLIDE SWITCH WITH EXTERNALLY MOUNTED PROTECTIVE CIRCUIT BREAKER

BACKGROUND OF THE INVENTION

The present invention relates to a switch and circuit breaker construction such as one which is typically utilized for optionally reversing the direction of current flow to a motor of an electric hand tool such as a power screwdriver, an electric drill, or an electric saw, and more particularly relates to such a switch and circuit breaker construction which can be compactly accomodated.

In the prior art, in such a particular case when a switch is provided for optionally reversing the direction of current flow to a motor of an electric hand tool such as a power screwdriver, an electric drill, or an electric saw, and when also a circuit breaker is provided to said electric hand tool for ensuring that the supply of electricity is interrupted when the amperage of electricity supply increases above a determinate level, it has been practiced to supply said switch and said circuit breaker as a pair. However, since in such an arrangement said switch and said circuit breaker are arranged separately in the electric hand tool, the internal space within the body of said electric hand tool is not utilized with very great efficiency, thus causing a waste of space. This makes the job of assembling the electric hand tool more difficult and causes an increase in the requirement for the size of said electric hand tool. Further, there is a concomitant difficulty with the assembly difficulty for said electric hand tool, due to the fact that said switch and said circuit breaker exist as two separate units. And the problem of parts management is also considerable, as is the storage requirement for such parts.

Also, as a subsidiary desideratum, a typical such switch as conventionally provided for optionally reversing the direction of current flow to a motor of an electric hand tool such as a power screwdriver, an electric drill, or an electric saw is a rotary type switch. However, such a rotary type switch tends to be rather complicated, incorporating a relatively large number of component parts, and accordingly a limit upon the compactness of the design of the switch is imposed. Therefore, the efficiency with which such a switch can be accomodated in the body of the electric hand tool is relatively poor. Further, the operation of such a reversing switch is relatively cumbersome for the user, because a rotary motion is required.

In the case of a slide switch such as might be conceived of for use as such a switch for optionally reversing the direction of current flow to a motor of an electric hand tool such as a power screwdriver, an electric drill, or an electric saw, typically such a slide switch is provided with terminals which are insert molded into a switch base, and with a slider member which slides one or more movable contact members over said terminals for switching over said terminals by connecting together various combinations thereof. However, since such a movable contact member or members is or are typically fixedly supported by the slider member, the problem tends to arise that the contact surface of such a movable contact member tends to become non uniform, and the contact thereof against the terminals over which it slides tends to become unstable, thereby possibly engendering poor contact and low reliability of the switch as a whole.

SUMMARY OF THE INVENTION

The inventors of the present invention have considered the various problems detailed above, particularly in the case of providing a switch for optionally reversing the direction of current flow to a motor of an electric hand tool and of also providing a circuit breaker for said electric hand tool motor.

Accordingly, it is the primary object of the present invention to provide a switch and circuit breaker construction, which avoids the problems detailed above.

It is a further object of the present invention to provide such a switch and circuit breaker construction, which is integrated as a single unit.

It is a further object of the present invention to provide such a switch and circuit breaker construction, which is compact.

It is a further object of the present invention to provide such a switch and circuit breaker construction, which is easily assembled to such an electric tool.

It is a further object of the present invention to provide such a switch and circuit breaker construction, which allows the body of such an electric tool to be constructed as compact.

It is a further object of the present invention to provide such a switch and circuit breaker construction, which facilitates the assembly of such an electric tool.

It is a further object of the present invention to provide such a switch and circuit breaker construction, which reduces problems of parts management and storage.

It is a yet further object of the present invention to provide such a switch and circuit breaker construction, which has a reduced number of component parts.

It is a yet further object of the present invention to provide such a switch and circuit breaker construction, which is convenient and easy in use.

It is a yet further object of the present invention to provide such a switch and circuit breaker construction, which has stable contacting action of a movable contact piece thereof against fixed terminals thereof.

It is a yet further object of the present invention to provide such a switch and circuit breaker construction, which prevents unevenness of the contact surface of such a movable contact piece thereof against such fixed terminals thereof.

According to the most general aspect of the present invention, these and other objects are attained by a switch and circuit breaker construction, comprising: a case; a plurality of contact members, exposed within said case for contact; a plurality of lead terminals electrically connected to some at least of said plurality of contact members, said lead terminals being insert molded in said case and protruding out to the outside thereof; a support member, insert molded in said case and protruding out to the outside thereof; and: a circuit breaker with two ends, provided outside said case, one said end of said circuit breaker being supported by one of said lead terminals, and the other said end of said circuit breaker being supported by said support member.

According to such a switch and circuit breaker construction as specified above, the problems detailed above are avoided, since the switch and circuit breaker construction is integrated as a single unit. Accordingly this switch and circuit breaker construction is compact, and is easily assembled to an electric tool as described above, such as a power screwdriver, an electric drill, or an electric saw. This switch and circuit breaker construction, being itself compact, thus allows the body of such an electric tool to be constructed as compact, and further, since it is only one unit rather than being two separate units as in the prior art, facilitates the assembly of such an electric tool, as well as reduceing problems of parts management and storage.

According to a particular specialization of the present invention, the above described and other objects may be more particularly attained by a switch and circuit breaker construction as described above, wherein said contact members, which are five in number, are arranged as being thus exposed within said case for contact in a substantially linear relationship, and alternatingly serve as input side and as output side contact members, with the end ones and the middle one thereof serving as contact members for being switchied between while the other two thereof serve as common contact members, said two end contact members being electrically connected together; and further comprising a pair of movable contact members each of which is mounted so as to be slidable, in synchronization with the other, over a corresponding one of said common contact members and the two contact members neighboring it. In this case, there will be a distinct advantage attained as compared to the conventional type of rotary switch, because of reduction in the number of component parts. Further, this switch and circuit breaker construction, which is of a slide type, will be notably convenient and easy in use.

According to an alternative particular specialization of the present invention, the above described and other objects may be more particularly attained by a switch and circuit breaker construction as first described above, further comprising a movable contact member which is mounted so as to be slidable over said contact members and a slidable impeller member with a surface confronting a surface of said movable contact member and slidingly impelling it, one of said surface of said slidable impeller member and said surface of said movable contact member being formed with a substantially hemispherical protuberance and the other thereof being formed with a substantially hemispherical depression which cooperates with said substantially hemispherical protuberance for thus coupling said slidable impeller member and said movable contact member with regard to mutual sliding motion thereof. In this particular switch and circuit breaker construction, stable contacting action of said movable contact member is provided against the fixed terminals. by the tilting action available by the cooperation of said substantially hemispherical protuberance and said substantially hemispherical depression, and unevenness of the contact surface of such a movable contact piece thereof against such fixed terminals thereof is positively prevented.

BRIEF DESCRIPTION OF THE DRAWINGS

The present invention will now be described with respect to the preferred embodiments thereof, and with reference to the illustrative drawings appended hereto, which however are provided for the purposes of explanation and exemplification only, and are not intended to be limitative of the scope of the present invention in any way, since this scope is to be delimited solely by the accompanying claims. With relation to the figures, spatial terms are to be understood as referring only to the orientation on the drawing paper of the illustrations of the relevant parts, unless otherwise specified; like reference numerals, unless otherwise so specified, denote the same parts and gaps and spaces and so on in the various figures relating to one preferred embodiment, and like parts and gaps and spaces and so on in the figures relating to different preferred embodiments; and:

DESCRIPTION OF THE PREFERRED EMBODIMENTS

The present invention will now be described with reference to the preferred embodiments thereof, and with reference to the figures.

THE FIRST PREFERRED EMBODIMENT

FIGS. 1 through 7 relate to the first preferred embodiment of the switch and circuit breaker construction of the present invention. This switch is adapted for reversing the rotational direction of an electric hand tool such as a power screwdriver.

Construction

Figure 1:
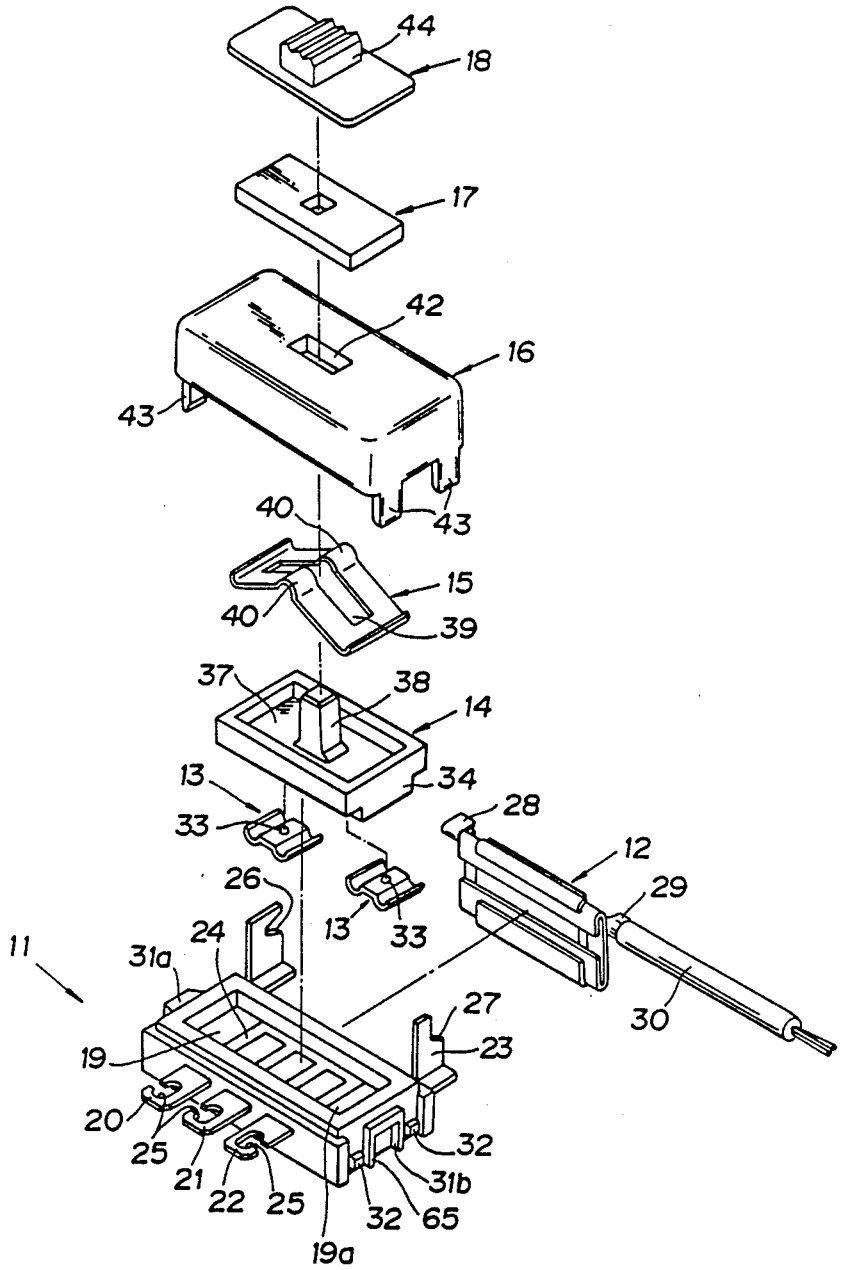
FIG. 1 is a perspective exploded view showing the main parts of the first preferred embodiment of the switch and circuit breaker construction of the present invention.
Figure 2:
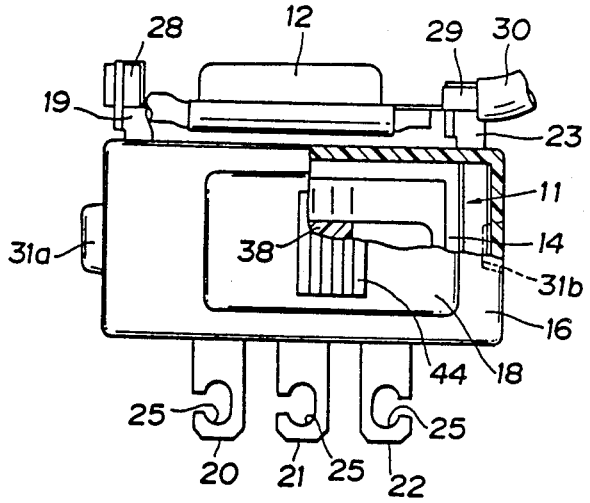
FIG. 2 is a plan view of said first preferred embodiment switch and circuit breaker construction in its assembled state.
Figure 3:
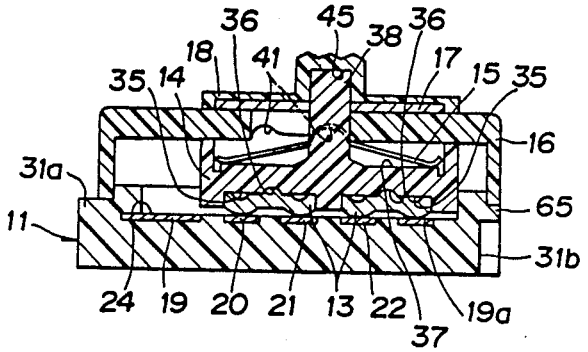
FIG. 3 is a longitudinal sectional view taken through said first preferred embodiment.
Figure 4:
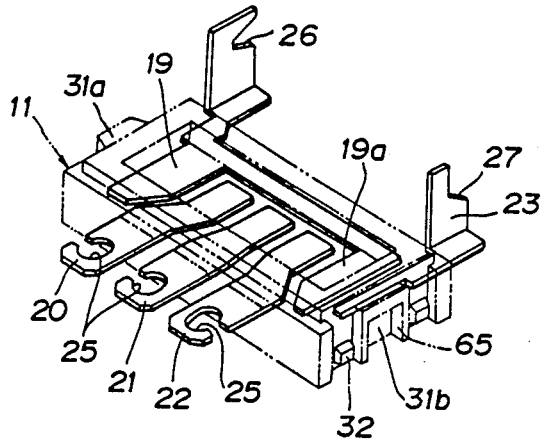
FIG. 4 is a perspective phantom view from underneath of said first preferred embodiment.

In the first preferred embodiment of the switch and circuit breaker construction of the present invention, shown in perspective exploded view in FIG. 1, in plan view in its assembled state in FIG. 2, in longitudinal sectional view in FIG. 3, and in perspective phantom view from underneath in FIG. 4, the reference numeral 11 denotes the base assembly of the switch as a whole, and 12 generally denotes a circuit breaker, while the members 13 are a pair of movable contact members and 14 generally denotes a slider impeller member. 15 is a sheet spring and 16 is a cover, while 17 is an anti dust protection sheet member and 18 is a knob assembly for being gripped for operation.

Figure 6:
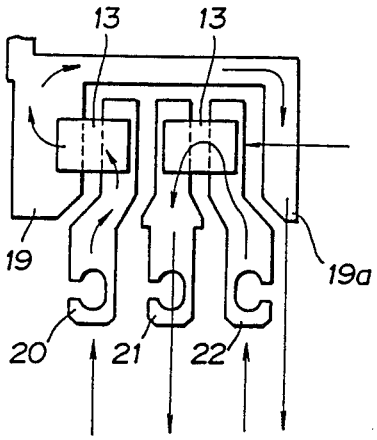
FIG. 6 is a diagram for illustrating the operation of said first preferred embodiment switch and circuit breaker construction, showing it in its state in which a one movable contact member bridges between a first lead terminal and a second lead terminal while another movable contact member bridges between a third lead terminal and a fourth lead terminal, thus causing a motor of a hand tool to be driven in the normal or the forward direction.
Figure 7:
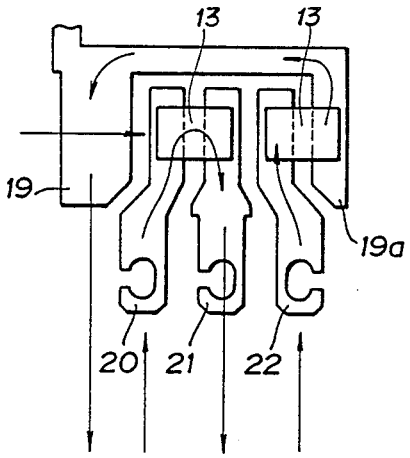
FIG. 7, similarly to FIG. 6, is another diagram for illustrating the operation of said first preferred embodiment switch and circuit breaker construction, showing it in its state in which said one movable contact member bridges between said second lead terminal and said third lead terminal while said other movable contact member bridges between said fourth lead terminal and a fifth lead terminal, thus causing said motor of said hand tool to be driven in the reverse direction.

In more detail, the switch base assembly 11 is generally rectangular and is formed by insert molding or a like process, with first through fifth lead terminals 19, 20, 21, 22, and 19*a* and a support piece 23 being arranged as molded thereinto and being held therein in a generally mutually parallel relationship. The upper surface in the figure of this switch base assembly 11 is formed with a rectangular depression 24 for receiving the movable contact members 13 to be described shortly, and surfaces of the lead terminals 19, 20, 21, 22, and 19*a* are exposed in this specified order within this rectangular depression 24 and lie substantially flush with its defining bottom surface, so that these exposed lead terminal surfaces can make contact with said movable contact members 13 which can smoothly slide on them as will be explained hereinafter. The schematic layout of these lead terminals 19, 20, 21, 22, and 19*a* as thus exposed within this rectangular depression 24 is shown in FIGS. 6 and 7. In this shown first preferred embodiment of the present invention, the first lead terminal 19 and the fifth lead terminal 19*a* are in fact electrically connected together although this is not shown in FIG. 1 (it can be seen in the underneath phantom view of FIG. 4 and in FIGS. 6 and 7), and are arranged as common terminals at the opposite ends of the row of lead terminals.

The second, third, and fourth lead terminals 20, 21, and 22 are formed with protruding portions which extend through the side towards the viewer in FIG. 1 of the rectangular depression 24 in the switch base assembly 11 so as to project to the outside. These projecting end portions of said second, third, and fourth lead terminals 20, 21, and 22 are formed with C-shaped notches denoted as 25 for having lead wires, not particularly shown, engaged with them. On the other hand, the first lead terminal 19 extends through the side away from the viewer in FIG. 1 of the rectangular depression 24 in the switch base assembly 11 so as to project to the outside at one end of said switch base assembly 11, and its outer free projecting end portion is then bent upwards from the point of view of the figure and is formed with a notch shape 26 on its upper outer edge portion. Similarly, the support piece 23 extends through the side away from the viewer in FIG. 1 of the rectangular depression 24 in the switch base assembly 11 so as to project to the outside at the other end of said switch base assembly 11, and its outer free projecting end portion is then bent upwards from the point of view of the figure and is formed with a L-shaped notch shape or cutaway 27 on its upper outer edge portion. To these notch shapes 26 and 27 there are respectively connected, by soldering or the like, the terminals 28 and 29 which are provided on the opposite ends of the circuit breaker 12. And to the one 29 of said terminals of said circuit breaker 12 there is connected a lead wire 30 which leads to a motor of a hand tool (according to the anticipated use of this first preferred embodiment) for supplying electrical energy thereto.

An engagement projection 31*a* is formed at the center of one of the short sides of the switch base assembly 11 for being engaged with an engagement depression, not particularly shown, formed on the body of the electric hand tool. And an engagement depression 31*b* is formed at the center of the other of the short sides of said switch base assembly 11 for being engaged with an engagement projection, also not particularly shown, similarly formed on the body of the electric hand tool. A ridge shape 65 is formed around this engagement depression 31*b*. And small projections 32 are formed on either sides of the ridge shape 65 around the engagement depression 31*b*.

Figure 5:
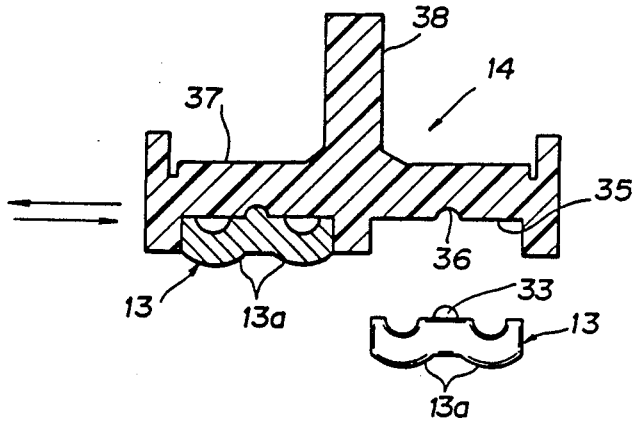
FIG. 5 is a longitudinal sectional view, showing a slider member included in said first preferred embodiment and two movable contact members associated therewith.

As best shown in the longitudinal sectional view thereof given in FIG. 5, each of the movable contact members 13 is generally shaped as a letter "W", and at the central portion of its upper surface (the central point of the "W" shape) a hemispherical protuberance 33 protrudes upwards therefrom, while on the other hand at the central portions of each of the "U" shapes which make up its "W" shape a convex "U" shape 13*a* is defined, suitable for sliding upon a cooperating member, which in fact is the bottom of the depression 24 of the switch base assembly 11 and the upper exposed surfaces of the lead terminals which lie flush therewith. In other words, each of the movable contact members 13 slides along said depression 24, by being pushed by the slider member 14 as will be described shortly, and electrically connects together one or another neighboring pair of the lead terminals 19, 20, 21, 22, and 19*a*, as will be described later and as shown in FIGS. 6 and 7. In fact, one of said movable contact members 13 slides between the first through the third lead terminals 19, 20, and 21, while on the other hand the other of said movable contact members 13 slides between the third through the fifth lead terminals 21, 22, and 19*a*.

Now, the slider member 14 is formed with a body, which has an upper depression 37 and a projecting protuberance 38 on its top side, and which has on its lower side a projecting portion 34 which fits into the depression 24 of the switch base assembly 11 so as freely to slide therein while being guided by the sides thereof. And a pair of engagement depressions 35 are formed in this projecting portion 34 for receiving the movable contact members 13, each of said engagement depressions 35 being formed with a hemispherical depression 36 for receiving the hemispherical protuberance 33 of the thus corresponding said movable contact member 13.

Thus, as the slider impeller member 14 is slid to and fro in the depression 24, it pushes the movable contact members 13 by the engagement of the hemispherical protuberances 33 into the corresponding hemispherical depressions 36, and the movable contact members 13 are thereby smoothly impelled to and fro to slide along the bottom surface of the rectangular depression 24 without being adversely tilted in any particular direction or being rocked due to torque imposed on them. This smooth pushing of the movable contact members 13 is due to the pivoting and swinging engagement of the hemispherical protuberances 33 into the hemispherical depressions 36. Thereby the movable contact members 13 vary their electrical connections with the lead terminals 19, 20, 21, 22, and 19*a*, as will be described later.

Into the depression 37 formed on the upper surface of the slider member 14 there fits a sheet spring member 15, which is formed with a slot 39 through its central portion for passing the projecting protuberance 38. This sheet spring member 15 is bent into the shape of a letter "V" and is received in said depression 37 with the central point of its "V" shape pointing upwards. This central point of the "V" shape of the sheet spring member 15 is formed with convex curved surfaces 40, 40 facing upwards in the figure.

A switch cover 16 is fitted over this whole switch assembly, said switch cover 16 being shaped like a box with an open bottom. An elongated slot 42 is cut through the upper surface of said switch cover 16 for passing the projecting protuberance 38 through, so that said projecting protuberance 38 moves to and fro along said slot 42 as the slider member 14 is reciprocated to and fro and the movable contact members 13 are moved along over their corresponding contacts 19 through 22 and 19*a*. On the inner surface of the switch cover 16 in pairs adjacent to the slot 42 there are formed depressions 41 (best seen in the sectional view of FIG. 3), and the convex curved surfaces 40, 40 of the sheet spring member 15 engage with a certain degree of firmness into these depressions 41 as the slider member 14 is thus reciprocatingly slid with the sheet spring member 15 providing biasing action betweeen the switch cover 16 and said slider member 14 and pressing the movable contact members 13 firmly against the aforesaid contacts, thus providing a clicking or indexing action for the operation of this first preferred embodiment of the switch and circuit breaker construction of the present invention.

Contact pieces 43 formed at the four corners of the switch cover 16 near its open bottom side engage with the projections 32 of the switch base assembly 11, so as to firmly and positively locate the switch cover 16 on the switch base assembly 11 when it is pressed thereover and fitted thereon. At this time, the sheet spring member 15 is somewhat compressed so as to provide the biasing action described above. The projecting protuberance 38 protrudes up outwards through the slot 42 of the switch cover 16 and engages into a hole 45 (best seen in the sectional view of FIG. 3) formed in the lower surface of the knob assembly 18, on the reverse side of the slider actuation knob 44. A anti dust protection sheet member 17 is provided between said knob assembly 18 and the switch cover 16 and is squeezed therebetween. Thereby the hand of a user of this first preferred embodiment of the switch and circuit breaker construction of the present invention may, by gripping the slider actuation knob 44 and pushing it, impel the slider member 14, etc., to and fro as described above.

Operation

This first preferred embodiment of the switch and circuit breaker construction of the present invention operates as will now be described.

When the knob assembly 18 is slid in the one direction, as shown in FIG. 6 one of the movable contact members 13 bridges between the first lead terminal 19 and the second lead terminal 20 while the other of said movable contact members 13 bridges between the third lead terminal 21 and the fourth lead terminal 22. In this condition of the apparatus, for example (according to the particular connection of the lead terminals, etc.), electric current flows from the second lead terminal 20 to the first lead terminal 19 on the one hand, and from the fourth lead terminal 22 to the third lead terminal 21 on the other hand, so as to drive the motor (not shown) of this hand tool in the normal or the forward direction.

On the other hand, when the knob assembly 18 is slid in the opposite direction to said one direction as shown in FIG. 7 said one of the movable contact members 13 bridges between the second lead terminal 20 and the third lead terminal 21 while the other of said movable contact members 13 bridges between the fourth lead terminal 22 and the fifth lead terminal 19*a*. In this condition of the apparatus, again for example, electric current flows from the second lead terminal 20 to the third lead terminal 21 on the one hand, and from the fourth lead terminal 22 to the fifth lead terminal 19*a* on the other hand, so as to drive the motor (not shown) of this hand tool in the reverse direction.

When due to any unusual circumstances or occurrence an electric current in excess of a determinate electrical current flows through the circuit breaker 12, then said circuit breaker 12 responds by going open circuit substantially immediately. Since the circuit breaker 12 is integrally provided with this switching apparatus, the two of them can be mounted together to an electric hand tool (such as a power screwdriver), in one action simply by mounting the switch base assembly 11 of the switching apparatus to said electric hand tool. Furthermore, the circuit breaker 12 does not require any particular extra space to be provided for it in the body of the electric hand tool, thus economizing the internal space within said body of said electrical tool. Also the handling of the switching device and of the circuit breaker 12 is simplified, since they are provided as one integral assembly instead of as two separate assemblies.

It will be understood that this construction of this first preferred embodiment of the switch and circuit breaker construction of the present invention is very compact, as opposed to a prior art type of rotary reversing switch: this is due to the great simplification of the contact structure as described above. Additionally, this first preferred embodiment of the switch and circuit breaker construction of the present invention can be installed in an electric hand tool in a manner which is efficient in terms of space requirements, and it offers simple and easy sliding operation.

Further, in this first preferred embodiment of the switch and circuit breaker construction of the present invention, because the movable contact members 13 are supported by the slider member 14 by way of the hemispherical protuberances 33 and the corresponding hemispherical depressions 36 which mate therewith, the movable contact members 13 are permitted to swing to and fro about these thus defined spherical pivot surfaces, as said movable contact members 13 slide over the contact terminals. Therefore, the contacting action of the movable contact members 13 is made very even, so that said movable contact members 13 can be ensured of making very intimate contact with the corresponding contact terminals, thus ensuring highly stable and reliable contact action.

In fact, even when the slider member 14 is subjected to an external force which is not directed in its direction of sliding, or the contact surfaces of the movable contact members 13 are otherwise caused to be uneven, since the rocking motion of the movable contact members 13 is permitted by the pivoting action between the hemispherical protuberances 33 and the corresponding hemispherical depressions 36 which mate therewith, thereby even and stable contact is promoted.

THE SECOND PREFERRED EMBODIMENT

Figure 8:
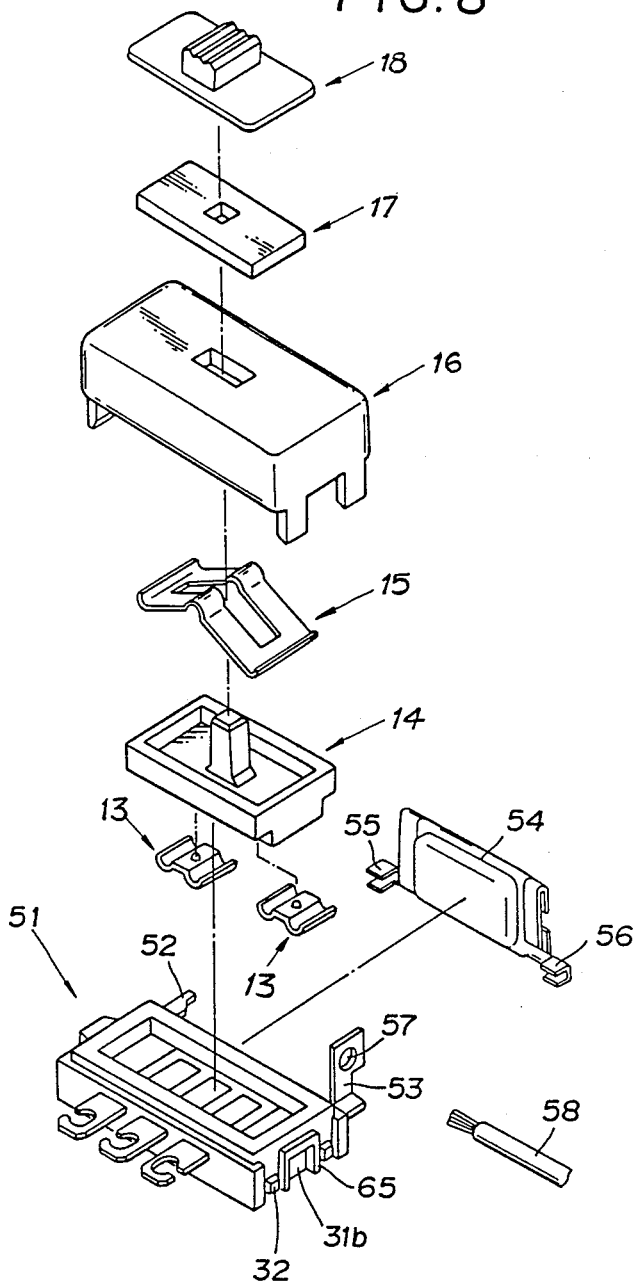
FIG. 8, similarly to FIG. 1 for the first preferred embodiment, is a perspective exploded view showing the main parts of the second preferred embodiment of the switch and circuit breaker construction of the present invention.

The second preferred embodiment of the switch and circuit breaker construction of the present invention is shown in FIG. 8, in a manner similar to FIG. 1 for the first preferred embodiment. In this figure, parts and gaps and spaces and so on which correspond to analogous parts and gaps and spaces and so on of the first preferred embodiment are denoted by reference numerals like to those utilized in the figures relating to said first preferred embodiment.

In this second preferred embodiment, the two terminals 55 and 56 of the circuit breaker 54 are connected to the lead terminals 52 and 53 which extend from either end of the switch base 51, respectively, and a lead wire connecting hole 57 is provided in the one 53 of the lead terminals for directly connecting thereto the lead wire 58 for the purpose of using this one 53 of the lead terminals of the switch base assembly 51 as a supporting member as well as a lead terminal.

The same functions and advantages are available with this second preferred embodiment of the of the present invention, as were available with the first preferred embodiment, and accordingly detailed description thereof will be eschewed in the interests of brevity of explanation.

Although the present invention has been shown and described in terms of the preferred embodiments thereof, and with reference to the appended drawings, it should not be considered as being particularly limited thereby, since the details of any particular embodiment, or of the drawings, could be varied without, in many cases, departing from the ambit of the present invention. Accordingly, the scope of the present invention is to be considered as being delimited, not by any particular perhaps entirely fortuitous details of the disclosed preferred embodiments, or of the drawings, but solely by the scope of the accompanying claims, which follow.

What is claimed is:

1. A switch and circuit breaker construction, comprising:

a pair of fixed common contact members disposed within a casing;

a plurality of fixed contact members disposed within said casing between said pair of fixed common contact members;

a plurality of lead terminals, one of said lead terminals being electrically connected to each of said plurality of fixed contact members, said lead terminals being insert molded in said casing and protruding outside said casing;

a pair of support members insert molded in said casing and protruding outside said casing, one of said support members being electrically connected to said pair of fixed common contact members;

circuit breaker means located outside said casing, said circuit breaker means having two ends, each end of said circuit breaker means being supported by one of said support members, said circuit breaker means being operably connected to a motor of an electrical tool; and at least two movable contact members slidably disposed in said casing, said movable contact members being slidable in synchronization with each other so that one of said movable contact members connects one of said pair of fixed common contact members to one of said plurality of fixed contact members, while the other of said movable contact members connects two of said plurality of fixed contact members together.

2. A switch and circuit breaker construction as claimed in claim 1, further comprising a slidable impeller member slidably disposed in said casing, said slidable impeller member having on a lower surface thereof at least two engagement depressions for receiving said movable contact members and a substantially hemispherical depression formed in each engagement depression, wherein each movable contact member comprises a substantially hemispherical protuberance which is received by one of said substantially hemispherical depressions.

3. A switch and circuit breaker construction as claimed in claim 2, wherein said pair of fixed common contact members and said plurality of fixed contact members are disposed in an essentially linear path, and said slidable impeller member is movable essentially perpendicular to the linear path.

* * * * *